US005083405A

United States Patent [19]

Miller

[11] Patent Number: 5,083,405

[45] Date of Patent: Jan. 28, 1992

[54] WALL PANEL MOUNTING SYSTEM

[75] Inventor: Frank Miller, Farmington, N.Y.

[73] Assignee: The Lamparter Organization, Inc., Farmingdale, N.Y.

[21] Appl. No.: 438,537

[22] Filed: Nov. 16, 1989

[51] Int. Cl.[5] ..... 304B 2/88

[52] U.S. Cl. ..... 52/235; 52/397; 52/573

[58] Field of Search ..... 52/235, 573, 397–403

[56] References Cited

U.S. PATENT DOCUMENTS

| | | | |
|---|---|---|---|
| 2,067,252 | 1/1937 | Whelan | 52/573 |
| 3,016,993 | 1/1962 | Owen | 52/402 X |
| 3,758,997 | 9/1973 | Vance | 52/400 X |
| 4,307,551 | 12/1981 | Crandell | 52/397 X |
| 4,561,225 | 12/1985 | Gartner | 52/235 X |
| 4,599,838 | 7/1986 | Kaminaga | 52/235 |
| 4,724,637 | 2/1988 | Evans | 52/235 X |

FOREIGN PATENT DOCUMENTS 2524517 10/1983 France ..... 52/573

*Primary Examiner*—David A. Scherbel
*Assistant Examiner*—Kien Nguyen
*Attorney, Agent, or Firm*—Collard, Roe & Galgano

[57] ABSTRACT

The present invention relates to a system for mounting a series of interconnected decorative panels onto the outer surface of a building. The system includes adjacent supporting means attached to the building outer surface. A first male flange is attached to the first end of the supporting means, while a second female flange is attached to the second end of the supporting means. An intermediate connector attaches a panel gripping means holding a panel to each flange. These panels are interconnected in series by coupling the male flange to the female flange.

9 Claims, 3 Drawing Sheets

WALL PANEL MOUNTING SYSTEM

BACKGROUND OF THE INVENTION

1. Field of the Invention

The present invention relates to a system for mounting a series of interconnected decorative panels onto the outer surface of a building. The system includes adjacent supporting means attached to the building outer surface. A first male flange is attached to the first end of the supporting means, while a second female flange is attached to the second end of the supporting means. An intermediate connector attaches a panel gripping means holding a panel to each flange. These panels are interconnected in series by coupling the male flange to the female flange.

2. The Prior Art

A known wall covering for the outside of a building is the product "Alucobond". This product is a composite aluminum panel composed of a aluminum face, a polyethylene core and an aluminum back, creating a "sandwich" effect. At the time this product was made and was being introduced into this country, there were no fastening devices to install this product. It was based on the installer's ingenuity to devise a way to erect the product and make it appear acceptable.

It is known to build exterior sections and panels for buildings at the plant and then ship the pre-finished sections to the job site. These sections were installed like a jigsaw puzzle, and caulking was required at the joints to create a watertight interface between the panels. As a result of expansion and contraction fluctuations over a period of time, the caulking would become fatigued causing it to rupture, thus destroying the watertight seal. In addition, all prior art systems had a single gasket which meant if there were a fluctuation of postive and negative pressures, due to wind or due to thermal expansion or contraction, rain water during a storm could penetrate the panels and cause damage thereto.

SUMMARY OF THE INVENTION

It is an object of the present invention to provide a system for mounting decorative wall panels on the outside of a building which will have no caulking in the joints and still provide for a dry free floating watertight seal between the panels.

It is another object of the present invention to provide a system for mounting decorative wall panels on the outside of a building that is of simple construction, of universal application which facilitates easy mounting, and is labor saving.

The above objects are accomplished in accordance with the present invention by providing a mounting system for decorative wall panels for buildings which are double-gasketed to accommodate both positive and negative pressures, and which are based upon having at least two independent units fitted together to create a caulkless, decorative and watertight connection.

The present invention is also directed to a system for mounting a series of interconnected decorative panels onto the outer surface of a building comprising at least two adjacent supporting means to be attached to said outer surface of the building, each supporting means having a first end and a second end; a first flange having means for attachment to said first end of each supporting means and having a male portion, a second flange having means for attachment to said second end of each supporting means and having a female portion; a panel gripping means for holding said decorative panel; a first intermediate connector for attaching said panel gripping means to said first flange; a second intermediate connector for attaching said panel gripping means to said second flange; and said panels being interconnected in series with the male portion of said first flange of one supporting means coupled with the female portion of said second flange of an adjacent supporting means.

The present invention has the advantages that it provides a mounting system for panels that is dry and watertight with no caulking in the joints. Even if there is a fluctuation of positive and negative pressures, water will not penetrate the system, due to the double gasketed seal which handles both the positive and negative pressures. A desirable feature of this system is the way two independent units are coupled together to create a caulkless, watertight connection. Its uniqueness lies in the fact that it has the versatility necessary to attach a variety of different decorative panels on the same substrate ranging from ¼" aluminum panels to 2" granite panels. The double gasket maintains the watertight seal even during relative movement between the panels caused by wind forces or by thermal expansion and contraction that can occur simultaneously where part of a building is in shadow and part is in direct sunlight. The initial mounting of the panels is greatly simplified by means of the male to female flange couplings that provide for a freely moveable attachment between panels that can be the same or different to produce a uniquely decorative appearance.

BRIEF DESCRIPTION OF THE DRAWINGS

Other objects and features of the present invention will become apparent from the following detailed description considered in connection with the accompanying drawing which discloses one embodiment of the present invention. It should be understood, however, that the drawing is designed for the purpose of illustration only and not as a definition of the limits of the invention.

In the drawing wherein similar reference characters denote similar elements throughout the several views.

DETAILED DESCRIPTION OF THE PREFERRED EMBODIMENT

Figure 1:
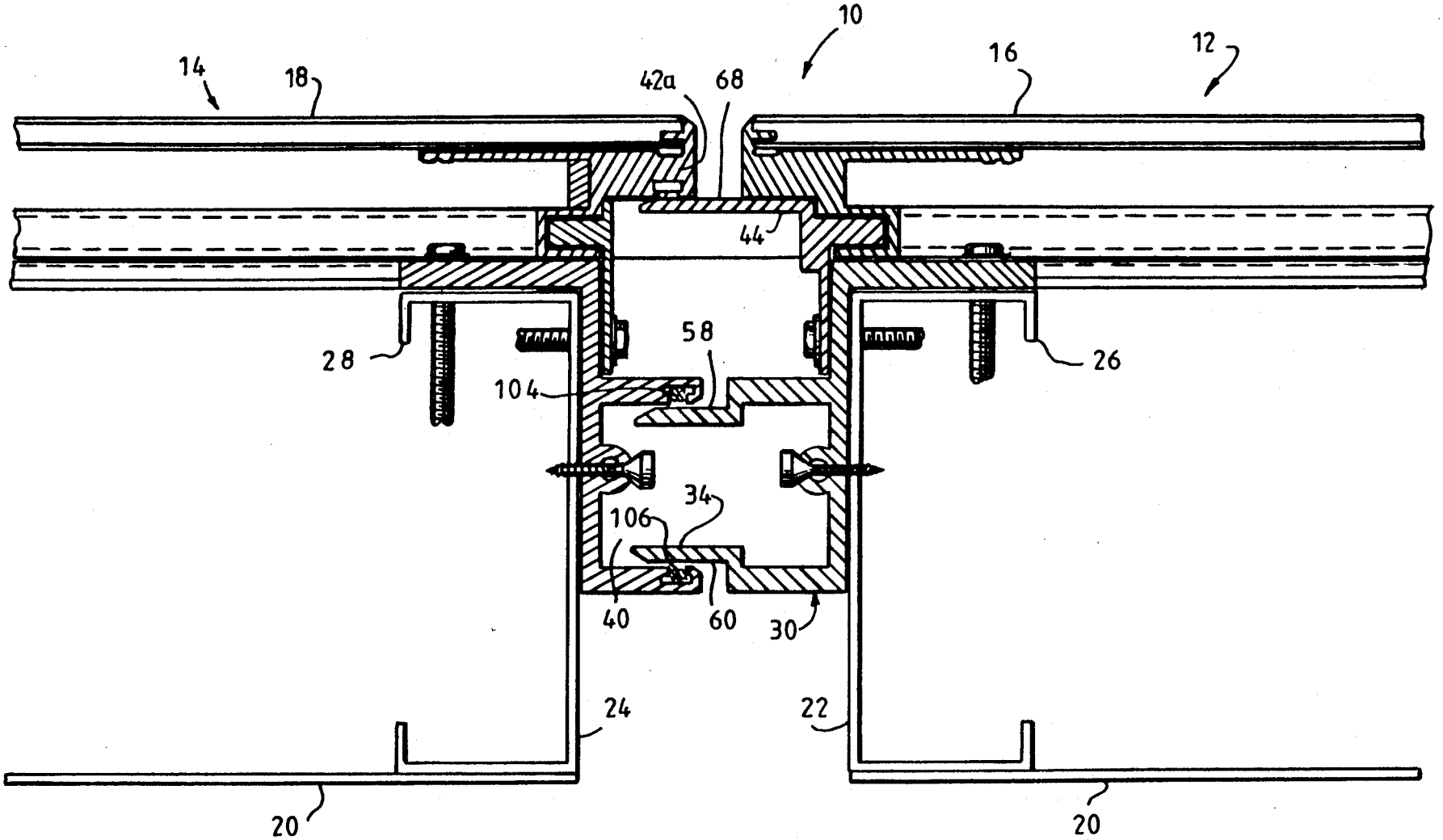
FIG. 1 shows cross section view of a mounting system for coupling together two decorative panels and for attaching them to the outside supporting structure according to the invention.

Referring now in particularity to the drawings, there is shown a system 10 for mounting a series 12 and 14 of interconnected decorative panels 16 and 18 onto the outer surface 20 of a building. The series 12 and 14 extend vertically above and below the plane of the paper in the drawing. The panels may be made, e.g., from plastic, metal, wood, glass, or stone or a combination thereof.

This mounting system comprises at least two adjacent supporting means 22 and 24 which can be attached to the outer surface 20 of the building. Each supporting means has a first end 26 and a second end 28. A first flange 30 has means for attachment 32, which is preferably a metal screw threaded fastener, for attaching it to said first end 26 of each supporting means, and the first flange has a male portion 34. A second flange 36 has means for attachment 38, which is preferably a screw threaded fastener, for attaching it to said second end 28 of each supporting means, and the second flange has a female portion 40. A panel gripping means 42 or 42*a* holds the decorative panel. A first intermediate connector 44 attaches the panel gripping means 42 to the first flange 30. A second intermediate connector 46 attaches the panel gripping means 42*a* to the second flange 36.

The panels 16 and 18 are interconnected in series with the male portion 34 of the first flange 30 of one supporting means 22 coupled with the female portion 40 of the second flange 36 of an adjacent supporting means 24.

The second flange 36 comprises an L-shaped means 48 joined at one end 50 to a C-shaped chamber 40 constituting the female portion 40. The first flange 30 comprises an L-shaped handle 52 joined at one end 54 to a reverse C-shaped chamber 56. The reverse C-shaped chamber 56 has an upper arm 58 spaced above a lower arm 60, with the upper arm 58 and the lower arm 60 together constituting the male portion 34 of the first flange. Thus, the upper arm 58 and the lower arm 60 of the first flange 30 can fit with the C-shaped chamber 40 of the second flange 36 when the panels 16 and 18 are interconnected in series 12 and 14.

The first intermediate connector 44 includes a first vertical stem 62 having an end 64, with a Z-shaped element 66 attached to the end 64. The Z-shaped element 66 has a long arm 68 and a short arm 70. The second intermediate connector 46 includes a second vertical stem 72 having an end 74, as well as having a right angular arm 76 attached to the end 74.

The panel gripping means 42 has a serpentine shaped member having a forward end 78, a middle section 80, and a back end 82. This forward end 78 has means 84 for gripping the panel 16. The back end 82 comprises means defining a channel shaped opening 86 into which the short arm 70 of the first intermediate connector 44 may be inserted and received. The middle section 80 connects the forward end to the back end.

The panel gripping means 42*a* is a serpentine shaped member having a forward end 78*a*, a middle section 80*a*, and a back end 82*a*. The forward end 78*a* has means 84*a* for gripping the panel. The back end 82*a* comprises means defining a channel shaped opening 86*a* into which the right angular arm 76 of the second intermediate connector 46 may be inserted and received. The middle section 80*a* connects the forward end 78*a* to the back end 82*a*.

The panel gripping means 42 for use with the first intermediate connector 44 is preferably an S-shaped serpentine construction. The panel gripping means 42*a* for use with the second intermediate connector 46 is preferably a reverse S-shaped serpentine construction. The same panel gripping means 42 or 42*a* preferably is interchangeable for use both with the first intermediate connector 44 and with the second intermediate connector 46, by reversing the direction of the panel gripping means as it grips the panel.

The panel gripping means 84 or 84*a* includes a shoulder 88 or 88*a* and a neck 90 or 90*a* for gripping the panel. The middle section 80 or 80*a* of the panel gripping means is preferably a rectangular part. The back end 82 or 82*a* of the panel gripping means includes means 86 or 86*a* defining a preferably C-shaped channel.

The first flange 30 further includes a first alignment means 92 for vertically placing one flange containing unit above or below another flange containing unit. The second flange 36 further includes a second alignment means 94 for the vertical placement of a flange containing unit either above or below an adjacent flange containing unit. The first alignment means 92 uses screw threaded fastener 93 to hold means 92 in correct alignment. The second alignment means 94 uses screw threaded fastener 95 to hold means 94 in correct alignment.

The C-shaped chamber 40 of the second flange 36 includes an upper finger 96 spaced apart from a lower finger 98 and each finger has means defining a channel 100 or 102 respectively. A first gasket 104 is placed in the channel 100 of the upper finger 96, and a second gasket 106 is placed in the channel 102 of the lower finger 98.

The series of decorative panels 12 and 14 refers to the fact that there may be several panel units 16 or 18 stacked vertically above one another or below one another and constituting the series 12, or the series 14, respectively. The attachment of several panels 16 vertically above and below one another is by conventional means just as the attachment of several panels 18 vertically below or above one another is by conventional means. The mounting system for the present invention is based upon horizontally connecting together the vertically arranged series of panels 12 and 14 by connecting them horizontally at the vertical edges utilizing the elements of the mounting system of the present invention. Thus, the panels may be placed around the entire outer face of the building including front, side and back in a continuous manner. This connection and mounting of the panels 16 and 18 would be done as follows. Starting with the several disconnected elements of the invention shown in FIG. 3, these elements would be connected in the manner shown in FIG. 2. There, in FIG. 2, it can be seen that all of those elements that are connected to the support means 26 are first assembled in the following manner. The flange 30 containing the male portion is either bolted or screwed with means 32 into position on support means 26. Then the intermediate connector 44 is either bolted or screwed into position with means 45 attaching it simultaneously to flange 30 and support means 26. Then gripping means 42 is attached to the decorative panel 16. At this point the portion 70 of intermediate connector is fitted into and received by the means 82 at the back end of the gripping means 42, so that the panel 16 is now locked into position indirectly connected to the flange 30 and supporting means 26. Simultaneously, the flange 36 containing female portion 40 is attached to support means 28 using bolt or screw threaded means 38. Then the intermediate connector 46 is attached utilizing attachment means 47 to the flange 36 and the support means 28. The decorative panel 18 is then attached to gripping means 42*a* on the front end portion, while the back end portion 82*a* of the gripping means receives the means 76 of the second intermediate connector 46 which is fitted into opening 82*a*. By this arrangement of elements the decorative panel 18 is indirectly connected to flange 36 and supporting means 28. Then gasket 104 is placed in the channel 100 and gasket 106 is placed in channel 102.

Figure 2:
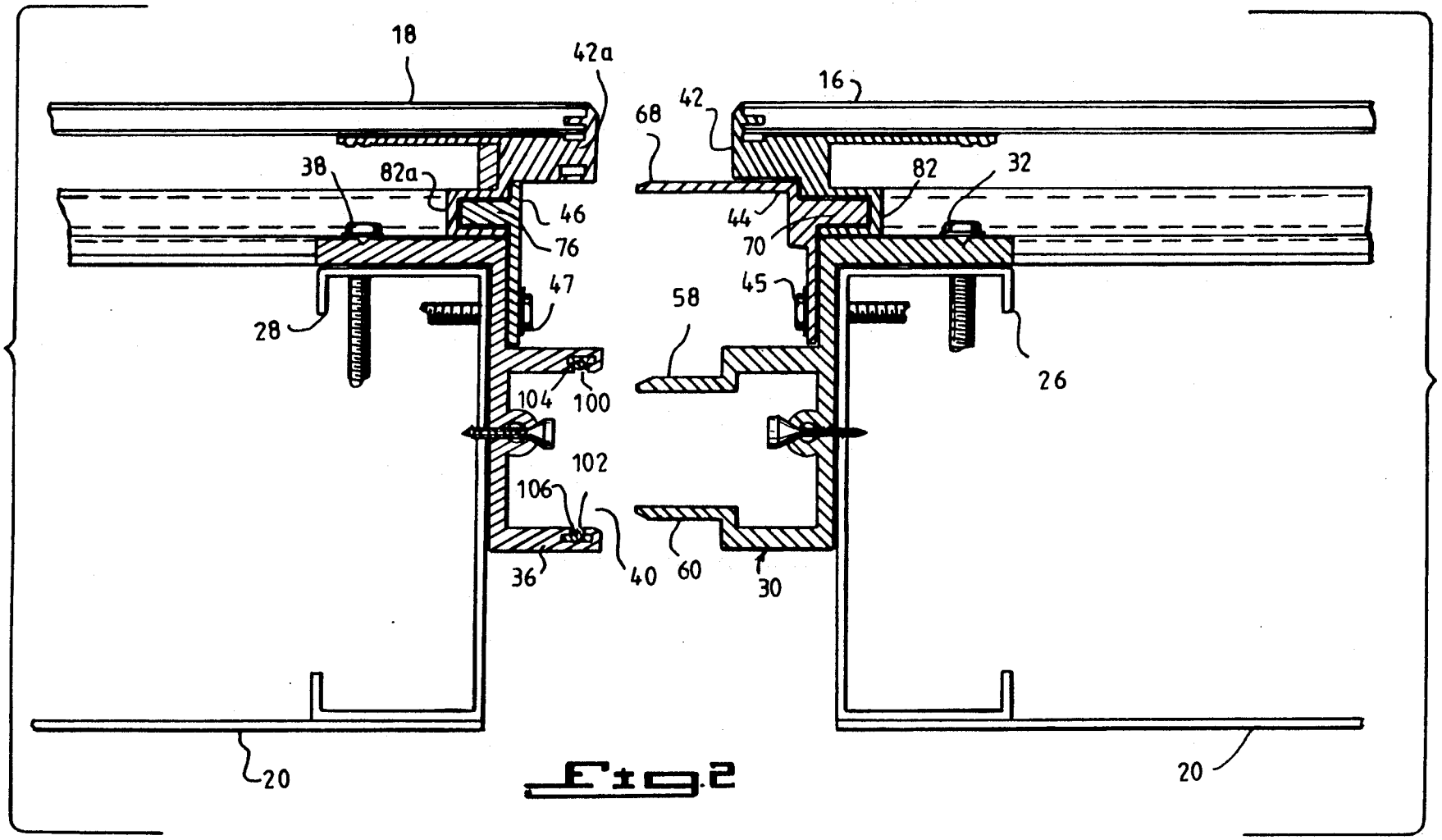
FIG. 2 shows a cross section view of the mounting system of FIG. 1 with the component parts attached to the male flange separated from the component parts attached to the female flange.
Figure 3:
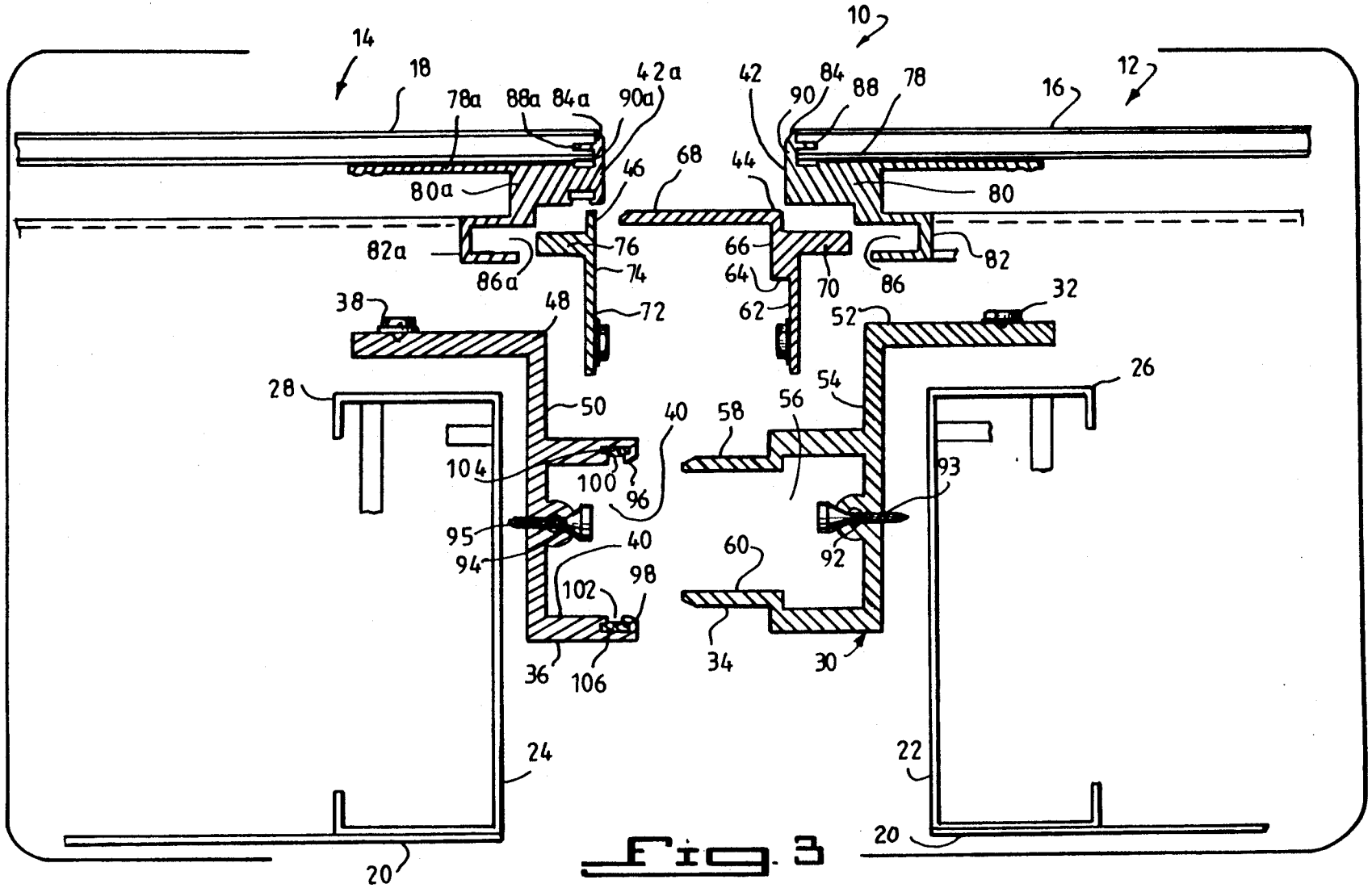
FIG. 3 shows an exploded cross section view of the mounting system of FIG. 1.

The subcombination of combined elements shown in FIG. 2 are then transported from the manufacturing site to the job site where they are to be attached to the building. Attachment to the building would be based upon first starting with panel 16 which is placed against the building and supporting structure 26 would be bolted into the face of the building 20. Means 20 could be, for example, a metal stud wall at the face of the building. Once the supporting means 26 is bolted to the building or fastened to building 20, the decorative panel 16 will be in place. Then the panel supporting means 28 for the decorative panel 18 is moved into the position shown in FIG. 1, wherein the male flange portion 58 and 60 is received within the female flange portion 40 to produce a watertight seal because of the gasket means 104 and 106. Then supporting means 26 is bolted in place. Also, the arm 68 of the intermediate connector 44 is placed in position adjacent to gripping means 42*a*. This is for aesthetic purposes so as to provide a way of concealing from the view of a person observing the completed facade of the building, the internal components of the structure that is supporting the decorative panels 16 and 18. In order to hold the vertically placed decorative panels in place, a picture frame type of supporting means surrounds all the panels around their entire outer perimeter (not shown).

Various modifications may, of course, be made to the system as will be apparent to those skilled in the art. For example, the construction and configuration of the panel gripping means 42, 42*a* may be modified to accommodate the type and size of the panel to be installed. Similarly, the construction and configuration of the other system elements may also be modified to suit the particular application intended without compromising the structural relationships hereinbefore described.

Thus, while only a single embodiment of the present invention has been shown and described, it is to be understood that many changes and modifications may be made thereunto without departing from the spirit and scope of the invention.

What is claimed is:

1. A system for mounting a series of interconnected decorative panels onto the outer surface of a building comprising:

at least two adjacent supporting means to be attached to said outer surface of the building, each supporting means having a first end and a second end;

a first flange having means for attachment to said first end of each supporting means and having a male portion;

a second flange having means for attachment to said second end of each supporting means and having a female portion;

said male portion located between said means for attachment of said first flange and said female portion of said second flange;

wherein said first flange comprises an L-shaped handle having an end joined to a reverse C-shaped chamber, said reverse C-shaped chamber having an upper arm spaced above a lower arm, with said upper arm and said lower arm together constituting said male portion of the first flange;

panel gripping means for holding said decorative panels;

one panel gripping means located adjacent to said first flange and another panel gripping means located adjacent to said second flange;

a first intermediate connector for attaching said panel gripping means to said first flange;

a second intermediate connector for attaching said panel gripping means to said second flange; and said panels being interconnected in series with the male portion of said first flange of one supporting means coupled with the female portion of said second flange of an adjacent supporting means.

2. A system for mounting a series of interconnected decorative panels onto the outer surface of a building comprising:

at least two adjacent supporting means to be attached to said outer surface of the building, each supporting means having a first end and a second end;

a first flange having means for attachment to said first end of each supporting means and having a male portion;

a second flange having means for attachment to said second end of each supporting means and having a female portion;

said male portion located between said means for attachment of said first flange and said female portion of said second flange;

panel gripping means for holding said decorative panels;

one panel gripping means located adjacent to said first flange and another panel gripping means located adjacent to said second flange;

a first intermediate connector for attaching said panel gripping means to said first flange;

a second intermediate connector for attaching said panel gripping means to said second flange;

said panels being interconnected in series with the male portion of said first flange of one supporting means coupled with the female portion of said second flange of an adjacent supporting means; and wherein said second flange comprises an L-shaped means having an end joined to a C-shaped chamber constituting the female portion; and wherein said first flange comprises an L-shaped handle having an end joined to a reverse C-shaped chamber, said reverse C-shaped chamber having an upper arm spaced above a lower arm, with said upper arm and said lower arm together constituting said male portion of the first flange, such that said upper arm and said lower arm of the first flange can fit within said C-shaped chamber of the second flange when said panels are interconnected in series.

3. The system of claim 2, wherein said C-shaped chamber of the second flange comprises an upper finger spaced apart from a lower finger, and each finger having means defining a channel; and a first gasket placed in the channel of the upper finger and a second gasket placed in the channel of the lower finger.

4. A system for mounting a series of interconnected decorative panels onto the outer surface of a building comprising:

at least two adjacent supporting means to be attached to said outer surface of the building, each supporting means having a first end and a second end;

a first flange having means for attachment to said first end of each supporting means and having a male portion;

a second flange having means for attachment to said second end of each supporting means and having a female portion;

said male portion located between said means for attachment of said first flange and said female portion of said second flange;

panel gripping means for holding said decorative panels;

one panel gripping means located adjacent to said first flange and another panel gripping means located adjacent to said second flange;

a first intermediate connector for attaching said panel gripping means to said first flange;

a second intermediate connector for attaching said panel gripping means to said second flange;

said panels being interconnected in series with the male portion of said first flange of one supporting means coupled with the female portion of said second flange of an adjacent supporting means; and wherein said first intermediate connector comprises a first vertical stem having an end, a Z-shaped element attached to said end, said Z-shaped element having a long arm and a short arm; and wherein said second intermediate connector comprises a second vertical stem having an end; and a right angular arm attached to said end.

5. The system of claim 4, wherein said panel gripping means comprises a serpentine shaped member having a forward end, middle section and a back end; said forward end having means for gripping said panel, said back end comprising means defining a channel shaped opening into which said short arm of the first intermediate connector may be received, and said middle section connecting said forward end to said back end.

6. The system of claim 5, wherein said panel gripping means comprises a serpentine shaped member having a forward end, a middle section, and a back end, said forward end having means for gripping said panel, said back end comprising means defining a channel shaped opening into which said right angular arm of the second intermediate connector may be received, and said middle section connecting said forward end to said back end.

7. The system of claim 6, wherein the panel gripping means for use with the first intermediate connector has an S-shaped serpentine construction;

wherein the panel gripping means for use with the second intermediate connector has a reverse S-shaped serpentine construction;

wherein the same panel gripping means is interchangeable for use both with the first intermediate connector and with the second intermediate connector, by reversing the direction of said panel gripping means as it grips said panel.

8. The system of claim 7, wherein said forward end of the panel gripping means comprises a shoulder and a neck for gripping said panel;

wherein said middle section of the panel gripping means comprises a rectangular part;

wherein said back end of the panel gripping means comprises means defining a C-shaped channel.

9. A system for mounting a series of interconnected decorative panels onto the outer surface of a building comprising:

at least two adjacent supporting means to be attached to said outer surface of the building, each supporting means having a first end and a second end;

a first flange having means for attachment to said first end of each supporting means and having a male portion;

a second flange having means for attachment to said second end of each supporting means and having a female portion;

said male portion located between said means for attachment of said first flange and said female portion of said second flange;

panel gripping means for holding said decorative panels;

one panel gripping means located adjacent to said first flange and another panel gripping means located adjacent to said second flange;

a first intermediate connector for attaching said panel gripping means to said first flange;

a second intermediate connector for attaching said panel gripping means to said second flange;

said panels being interconnected in series with the male portion of said first flange of one supporting means coupled with the female portion of said second flange of an adjacent supporting means; and wherein said first flange further comprises a first alignment means for vertical placement; and wherein said second flange further comprises a second alignment means for vertical placement.

* * * * *